US007841155B2

(12) United States Patent
Zellermann et al.

(10) Patent No.: US 7,841,155 B2
(45) Date of Patent: Nov. 30, 2010

(54) TOOL FOR A BAG FORMING MACHINE

(75) Inventors: Michael Zellermann, Verl (DE); Hartmut Ringel, Oerlinghausen (DE)

(73) Assignee: Mediseal GmbH, Schloss Holte-Stukenbrock (DE)

( * ) Notice: Subject to any disclaimer, the term of this patent is extended or adjusted under 35 U.S.C. 154(b) by 140 days.

(21) Appl. No.: 12/247,576

(22) Filed: Oct. 8, 2008

(65) Prior Publication Data

US 2009/0098993 A1 Apr. 16, 2009

(30) Foreign Application Priority Data

Oct. 13, 2007 (DE) ..... 10 2007 049 210

(51) Int. Cl.
*B65B 9/22* (2006.01)

(52) U.S. Cl. ..... 53/451

(58) Field of Classification Search ..... 53/451, 53/551, 450

See application file for complete search history.

(56) References Cited

U.S. PATENT DOCUMENTS

| | | | | |
|---|---|---|---|---|
| 3,415,171 | A | 12/1968 | Wilson | |
| 5,046,300 | A * | 9/1991 | Custer et al. | 53/412 |
| 6,052,970 | A | 4/2000 | Fujimoto | |
| 6,832,462 | B2 * | 12/2004 | Peacock et al. | 53/412 |
| 7,028,451 | B2 * | 4/2006 | Braun et al. | 53/550 |
| 7,069,707 | B2 * | 7/2006 | Braun et al. | 53/201 |
| 2003/0196979 | A1 | 9/2003 | Kurth | |
| 2005/0039422 | A1 | 2/2005 | Braun et al. | |
| 2005/0044822 | A1 | 3/2005 | Braun | |

FOREIGN PATENT DOCUMENTS

| | | |
|---|---|---|
| CH | 490 995 | 5/1970 |
| CH | 490955 | 5/1970 |
| DE | 38 41 056 | 6/1989 |
| DE | 69803525 | 8/2002 |
| DE | 10209356 | 9/2003 |
| DE | 10251072 | 5/2004 |
| DE | 20320160 | 7/2004 |
| DE | 10330852 | 2/2005 |
| EP | 1 495 965 | 12/2005 |

OTHER PUBLICATIONS

European Search Report dated Sep. 11, 2009.
English language translation of abstract of DE 38 41 056 (published Jun. 22, 1989).

* cited by examiner

*Primary Examiner*—Hemant M Desai
(74) *Attorney, Agent, or Firm*—Thomas, Kayden, Horstemeyer & Risley, LLP

(57) ABSTRACT

A tool (4) is part of a bag forming machine (1) for deforming a plain web of wrapping material (33) into a tube for producing bags containing goods. The tool (4) includes a filling pipe (3) and a forming shoulder (2) including a movable first part (7), a movable second part (8), a stationary third part (13) and a channel (18) housing the filling pipe (3). The filling pipe (3) and the channel (18) form a passage gap (27) allowing for passage of the wrapping material (33). The first and second parts (7, 8) are pivotable with respect to one another such that they can be moved into a closed position and into an opened position while approximately moving in a radial direction (29 with respect to the surface of the filling pipe (3) and perpendicular to the tubular wrapping material (33) to prevent clamping or squeezing of the wrapping material (33).

15 Claims, 4 Drawing Sheets

TOOL FOR A BAG FORMING MACHINE

CROSS REFERENCE TO RELATED APPLICATIONS

This application claims priority to co-pending German Patent Application No. DE 10 2007 049 210.5 entitled "Werkzeug für eine Schlauchbeutelmaschine zum Umformen eines Hüllmaterialstreifens in einen Schlauch", filed Oct. 13, 2007.

FIELD OF THE INVENTION

The present invention generally relates to a tool for a bag forming machine for deforming a web of wrapping material to a tube. The tool includes a forming shoulder and a filling pipe.

The present invention also relates to a bag forming machine including such a tool.

The forming shoulder and the filling pipe when being part of a vertical bag forming machine are located to have a common center axis usually being located in a vertical direction. In this way, filling material to be packed in the bags is introduced through the filling pipe under the influence of gravity. However, it is also possible to arrange the forming shoulder in a horizontal bag forming machine such that the center axis is arranged in a horizontal direction. Especially in such a case, it makes sense to use a screw feeding device.

For example, the filling material may be a solid material in the form of powder or granulate such as, for example, sugar, salt, tobacco crumbs, tobacco powder, tealeaves and the like. The filling material may also be a liquid or a pasty mass such as, for example, mustard, spices, milk and the like. The filling material may also be a solid material such as chocolates, chocolate bars, dry yeast, single-use syringes, tooth picks, spoons and the like.

BACKGROUND OF THE INVENTION

A tool for a bag forming machine for deforming a web of wrapping material including one layer into a tube is known from Swiss Patent No. CH 490 995. The tool includes a forming shoulder including a plurality of parts and a filling pipe. The forming shoulder is designed to be divided in a division plane, the division plane being defined by the center axis of the filling pipe and of the forming shoulder and by the center line of the wrapping material. The forming shoulder is also divided in a second division plane, the second division plane being located vertical and parallel to the axis of the roll from which the wrapping material is wound off. The forming shoulder thus includes a stationary part and two movable parts. The movable parts of the forming shoulder are arranged to be manually pivotable with respect to one another about two rotational axes extending parallel to the center axis. In this way, they may attain a closed position and an opened position. The rotational axes of the movable parts of the forming shoulder are located in a second division plane through the center axis. The two pivotable parts of the forming shoulder are movable into the closed position and into the opened position to simplify introduction of the wrapping material into a channel between the forming shoulder and the filling pipe. The forming shoulder includes a guiding surface for the wrapping material and the channel for arranging the filling pipe. In the opened position of the two pivotable parts of the forming shoulder, the filling pipe may be pivoted about a horizontal axis and a vertical axis out off the channel. A passage gap continuously extending over the circumference is located between the filling pipe and the channel. The passage gap serves for passage of the wrapping material and of the tube, respectively. It is not disclosed in this prior art reference if and how the tube can be sealed by a longitudinal seal. When pivoting the pivotable parts of the forming shoulder into the opened position and when pivoting away the filling pipe, the interior of the forming shoulder becomes accessible for simplified handling of the wrapping material to be introduced. However, substantial skills are required to attain a stable starting position of the wrapping material to begin production. When pivoting the pivotable parts of the forming shoulder into the opened position, the pivotable parts are pivoted by 180° in an outward direction such that it is necessary to arrange a plurality of webs of wrapping material comparatively far away from one another. When pivoting the pivotable parts of the forming shoulder into the closed position, gaps being formed at the forming shoulder in a longitudinal direction are closed in the region of the joints such that there is the danger of squeezing the wrapping material.

A vertical bag forming machine including a tool including a forming shoulder and a filling pipe is known from German Patent Application No. DE 103 30 852 A1 corresponding to US Patent Application No. US 2005/0044822 A1. The forming shoulder is designed to be divided in a vertical division plane such that the forming shoulder can be opened. The division plane is arranged parallel to the axis of the roll from which the wrapping material is unwound, and it extends through the center axis of the filling pipe. In this way, a shoulder sleeve including two separate shoulder parts is formed. Furthermore, structural units including one sleeve part and one trim part are formed. One structural unit can be removed from the other structural unit to be capable of removing the filling pipe from the forming shoulder in a transverse direction with respect to the transporting direction. Due to the change of the distance between the structural units, it is also possible to produce bags of different widths. The accessibility of the interior of the divided forming shoulder, for example for simplifying introduction of the wrapping material, is only slightly increased. There is the danger of the wrapping material being squeezed or clamped when pivoting the parts of the forming shoulder into the closed position. Adjustment of the parts of the forming shoulder with respect to one another for variation of the width of the bags is conducted manually when setting up the bag forming machine.

A divided forming shoulder for a bag forming machine is known from German Patent Application No. DE 102 51 072 A1. The division plane between the two parts of the forming shoulder extends in a vertical direction in a way that a plane parallel to the separation plane extends through the axis of the roll from which the wrapping material is unwound. The known machine includes an adjustment unit for changing and fixing the distance between the two parts of the forming shoulder. This serves to easily adapt the machine to a different width of the wrapping material. During operation of the bag forming machine, the two parts of the forming shoulder are arranged to be stationary and not to move with respect to one another. Changing the distance between the two parts of the forming shoulder is only realized when changing the setting of the bag forming machine for adaption to a wrapping material having a different width.

A tool for a bag forming machine including a forming shoulder and a filing pipe is known from German Utility Model No. DE 203 20 160 U1. The forming shoulder includes a channel for arrangement of the filling pipe. A passage gap for passage of the wrapping material being deformed into a tube is located between the filing pipe and the channel. The channel begins at a deflecting edge. The deflecting edge results from an intersection line of the guiding surface of the forming shoulder in the introduction part with the channel. The deflecting edge does not continuously extend over the circumference of the channel, but it is designed to have an opened rim. The shoulder-like collars of the forming shoulder are usually designed not to be symmetric and to overlap. When the wrapping material is pulled over the forming shoulder and enters the channel, there is friction resulting in wear and tear. Wear and tear substantially influences the deflecting edge. A pulling force by a discharging device of the bag forming machine acts upon the wrapping material. The pulling force determines the pressure of the wrapping material against the deflecting edge. The disadvantageous friction conditions and conditions of wear and tear in the region of the deflecting edge are the reason for the fact that the forming shoulder can only fulfill its desired function during a limited period of time, and it then needs to be replaced. To make replacement of the forming shoulder easier and less expensive, the forming shoulder is designed to include a plurality of parts, and it includes a small insert forming a part of the forming shoulder in the region of the deflecting edge. Consequently, it is only necessary to replace the insert instead of the entire forming shoulder. The insert may be made of a harder material than the remaining part of the forming shoulder. During operation of the bag forming machine, the two parts of the forming shoulder are fixedly interconnected, especially by screws. The insert is only detachable and attachable when the worn insert is to be replaced by a new insert.

A forming shoulder including a plurality of parts for a bag forming machine is known from German Patent Application No. DE 102 09 356 A1 corresponding to US Patent Application No. US 2003/0163979 A1. The forming shoulder serves to form a double tube such that the channel extending through the forming shoulder has a comparatively complicated surface. To simplify manufacture of the channel from a block of solid material, the forming shoulder is divided by a division plane into three parts. In this known vertical bag forming machine, the division plane extends in a vertical direction through the middle axes of the two channels forming the double tube. The two detachable parts of the forming shoulder form covers for the channel. The division plane thus extends parallel to the backward plane of the forming shoulder. If one imagines the tube-like deformed wrapping material in the region of the channel to be deformed back into its plain configuration, the division plane is located in the plane of the wrapping material. During operation of the bag forming machine, the parts of the forming shoulder are fixedly interconnected, and they thus cannot be moved with respect to one another.

A bag forming machine for deforming a plain web of wrapping material into a tube is known from German Patent No. DE 698 03 525 T2 corresponding to U.S. Pat. No. 6,052,970. The bag forming machine does not include a forming shoulder, but instead a plurality of spaced apart forming rollers. To optimize the sealed condition of the overlapping portions of the tube-like web, the height position of the lower forming roller can be adjusted in a perpendicular direction.

SUMMARY OF THE INVENTION

The present invention relates to a tool for a bag forming machine for deforming a plain web of wrapping material into a tube. The tool includes a filling pipe having a surface and a center axis. The tool also includes a forming shoulder including a first part, a second part and a third part. The forming shoulder includes a channel. The filling pipe is arranged in the channel. The filling pipe and the channel are designed and arranged to form a passage gap being designed and arranged to allow for passage of the web of wrapping material and of the tube, respectively. The third part is designed and arranged to be stationary and to continuously extend in a vertical direction to limit the channel by a circumferential angle which is less than 180°. The first part and the second part are arranged next to the third part to form a part of the channel. The forming shoulder is designed and arranged to be divided in a division plane to form the first part and the second part. The division plane is defined by the center axis and by a center line of the web of wrapping material. The first part and the second part are designed and arranged to be pivotable with respect to one another such that the first part and the second part can be moved into a closed position in which they surround the filling pipe and into an opened position. The first part and the second part are designed and arranged to be pivotable such that they move approximately in a radial direction with respect to the surface of the filling pipe and thus approximately perpendicular to the extension of the wrapping material in a circumferential direction when being moved into the closed position.

The novel tool for a bag forming machine substantially reduces the problem of the wrapping material being squeezed or clamped in a gap of the forming shoulder when introducing the wrapping material. The wrapping material (or foil) is the material which serves for wrapping the goods (also called the filling material) to be packed in the bags produced from the endless tube.

The forming shoulder is a three dimensional body made of a firm material. The material may be a solid material or a sheet material, usually made of steel or other suitable materials. The wrapping material is unwound from a roller as a plain web, and it is deformed into a tube by the forming shoulder. Preferably, the wrapping material is made of plastic. The wrapping material may include one layer or a plurality of layers. When using a plurality of layers, the layers more or less overlap depending on whether they have the same width or different widths. The plurality of layers is simultaneously deformed into a tube by the forming shoulder. The tube may have an annular, rectangular or different convex cross-section. The geometry of the guiding surface of the forming shoulder, meaning the surface contacting the wrapping material, is sized and designed such that each fiber of material of the wrapping material travels along a path of the same length such that the distance of adjacent fibers of material in a direction transverse to the direction of movement remains constant. In other words, the wrapping material is not partially stretched, extended or otherwise plastically deformed.

A difficult situation known in the field of bag forming machines occurs when changing the roll of wrapping material. It may be desired not to separately introduce the new web of wrapping material, but to instead glue the end of the previous web of wrapping material to the beginning of the following new web of wrapping material. The joint resulting from gluing is then pulled over the deflecting edge and through the passage gap between the channel and the filling pipe to prevent the necessity of having to disassemble and reassemble the filling pipe. Such a joint approximately has twice the thickness of the wrapping material or at least an increased thickness. If this thickness exceeds the thickness of the passage gap, it is not possible to use this procedure since it would result in the wrapping material being torn.

If one operates with a plurality of webs one next to the other, the width of the wrapping material determines the width of the required space for each single forming shoulder of the plurality of forming shoulders being located next to one another. The division determined by the center axes of the forming shoulders and of the filling pipes, respectively, corresponds to the width of the wrapping material. It becomes more difficult to introduce the wrapping material or to replace the rolls using the gluing technique when the diameters are decreased.

It is the perception of the applicant that especially in case of tubular bags having a small diameter—meaning diameters of approximately 3 mm to 15 mm relating to a tubular bag having an annular cross-section—at the beginning of operation there is the problem to introduce the wrapping material coming from the roll into the channel between the forming shoulder and the filling pipe and to bring it in such a relative position that the wrapping material is not moved in an undesired lateral direction. Instead, it is desired that the wrapping material remains in a symmetrical arrangement with respect to the common center axis of the forming shoulder and of the filling pipe and in a plane through the center axis, respectively, the plane intersecting the axis of the roll in a perpendicular direction. If the wrapping material is arranged with respect to this plane in a non-symmetric way, there is a limit separating the two regions. The first region is one that can be used in a direction towards the center axis in which the wrapping material tends to approach a symmetric relative position and to maintain this relative position during operation of the bag forming machine. In the second region, the wrapping material has the tendency of moving in a lateral direction such that it departs from the symmetric relative position more and more.

It is to be understood that introducing the wrapping material has to be realized in a way that the wrapping material is located in the above described first region. The problems described above do not only relate to the introduction of the wrapping material into the passage gap at the beginning of operation, but also in case the web of wrapping material is torn or a new roll is to be used. Tear of the wrapping material during operation of the machine in fact occurs in reality, especially if the material of the wrapping material is a sensitive fleece material, for example cellulose.

These problems are even increased when two layers of wrapping material are used, for example if two webs of wrapping material of the same width or of different widths which overlap have to be introduced into the passage gap between the forming shoulder and the filling pipe.

The problems are further increased if one operates with a plurality of adjacent webs, meaning a web of material continuously extending over the width of the web of material. This web is unwound from the roll, and it is then cut in a longitudinal direction to attain a plurality of parallel webs of material of which each has to be introduced into a passage gap. Such an operation using a plurality of webs often results in a defect in the sense of one web or a plurality of webs, but not all webs, being torn. This makes it necessary to reintroduce the torn webs of wrapping material and to pull along the other webs of wrapping material. Due to the fact that the thickness of the passage gap usually only is slightly greater than the material thickness of the wrapping material, the filling pipe has to be removed from the forming shoulder for introducing the wrapping material. This is realized by pulling out the filling pipe in an axial direction, meaning by a relative movement of the filling pipe in the direction of the center axis. The wrapping material is then screwed up or twisted together and pushed through the channel which has become accessible. In the following, the filling pipe has to be reassembled. For this purpose, it is necessary to open the screwed up or twisted together web of wrapping material such that it attains a tubular shape and the filling pipe can be introduced into the interior. Even now one needs to pay attention to the position of the edges of the web of wrapping material to make sure that they attain a position in which they can be connected by sealing, as it is required for a longitudinal seal. Any eccentric position of the web of wrapping material outside of the first region as explained above results in a tendency for continued lateral dislocation of the web of wrapping material such that it does not automatically attain its correct position. This effect may be counteracted by trying to manually bring the web of wrapping material in its symmetric position. This is especially difficult when using a plurality of layers or if the tube has to have an especially small diameter, meaning if the width of the tube is smaller than the fingers of an operator who introduces the web of wrapping material. It is not exceptional that it takes approximately 5 minutes to 30 minutes to introduce the wrapping material. The period of time depends on the diameter, the skills of the operator and the kind of material.

The forming shoulder according to the present invention is designed to be divided. The separation or division of the forming shoulder is realized through a first division plane being a vertical division plane through the common center axis of the filling pipe and of the forming shoulder and of the center line of the web of wrapping material. This first division plane thus extends perpendicular to the axis of the roll from which the wrapping material is unwound. A second division plane is used, the second division plane being located in a horizontal direction in a vertical bag forming machine. In this way, the forming shoulder includes at least three parts. One part is designed as a stationary part, meaning it is not moved during production, and it is only replaced if it is worn. The other two parts are movable parts which are pivotable about one rotational axis or two rotational axes parallel to the center axis. The movable parts of the forming shoulder and the filling pipe can be pivoted back and forth between a closed position and an opened position. In the closed position of the movable parts and when the filling pipe is located in the channel of the forming shoulder, there is a passage gap for passage of the wrapping material. The passage gap is located between the outer wall of the filling pipe and the inner wall of the channel. The passage gap substantially extends continuously in a circumferential direction. In the circumferential direction of the filling pipe, meaning in a horizontal section, the passage gap almost extends about 360° and is only designed to be opened to allow for passage and preparation of the edges of the wrapping material for the longitudinal seal.

The stationary part of the forming shoulder preferably continuously extends over the entire height of the tool in a vertical direction. In the circumferential direction of the channel and of the filling pipe, the stationary part only extends over a circumferential angle which is less than 180°. It has been found that an angle in a range of approximately 110° is especially advantageous. This angle is related to the pivotal movement of the movable parts of the forming shoulder and their special design. The portions of the movable parts of the forming shoulder which partly form the channel next to the stationary part of the forming shoulder are designed and arranged such that they are pivotable about their rotational axes in a way that they move at least approximately in a direction radial to the surface of the filling pipe and thus perpendicular to the extension of the wrapping material in a circumferential direction when being moved into the closed position. When the movable parts of the forming shoulder are moved into the closed position, no gaps between the movable parts and the stationary part are closed at this place. Such gaps could otherwise squeeze or clamp the wrapping material. Instead, these portions are moved perpendicular with respect to the wrapping material. Other portions of the movable parts of the forming shoulder, especially the free end portions adjacent to the material portions from which the seal seam is formed, are moved tangentially with respect to the surface of the wrapping material. However, there are no gaps at this place in which the wrapping material could get squeezed or clamped. In these portions, the wrapping material is manually held and smoothened during introduction of the wrapping material. This is realized by respective recesses located in the movable parts of the forming shoulder facing the operator.

Preferably, the rotational axes about which the movable parts of the forming shoulder are pivoted are located behind the second division plane as seen from the perspective of the operator. The two rotational axes may be advantageously combined to one common rotational axis being located in the first division plane.

Preferably, there is a controlled drive serving to realize movement of the two movable parts of the forming shoulder. Such a controlled drive is to be understood as a pneumatic, hydraulic or electric drive which can be operated by a respective control signal. This drive is designed and arranged such that the movable parts of the forming shoulder can be at least moved from the closed position into the opened position when switching on the drive. The movement from the opened position into the closed position may also be realized by this drive. However, it is preferred if a return spring is used for this movement. The spring force of the return spring is chosen comparatively weak such that there is no danger of squeezing the fingers of the operator.

The design of the stationary part is coordinated to the design of the movable parts of the forming shoulder. The stationary part itself may be designed as one piece or as a plurality of pieces. Due to the second division plane, the upper portion of the stationary part may be connected to a cap, or it may form a cap. The cap does not only form a guiding surface for the wrapping material which does not change when opening the movable parts. The cap may also be designed such that it overlaps and surrounds, respectively, the movable parts of the forming shoulder in the closed position as seen in a vertical projection such that the wrapping material being introduced is not endangered. The channel of the forming shoulder begins in the region of the cap. The channel may extend over slightly more than 180°, the channel being limited by the other diameter of the filling pipe. This results in the wrapping material in the region facing away from the operator being tightened when pivoting the filling pipe into the channel of the cap. The two movable parts of the forming shoulder can be moved by the controlled drive from the closed position into the opened position such that the channel of the bag forming machine becomes accessible from the front. This opened position is advantageously used when introducing the wrapping material. However, it is also possible that the controlled drive realizes intermediate positions between the closed position and the opened position of the movable parts of the forming shoulder. Such intermediate positions can be used in connection with a filling pipe which is supported in a removable way to allow for use of the gluing technique and the enlargement of the thickness of the wrapping material to allow for uninterrupted operation during a change of the rolls of wrapping material. An insertion operation is then only required if the web of wrapping material is torn.

The position of the first division plane does not only serve to control the above described problem of wear and tear and for simplified manufacture of the forming shoulder, but it also relates to the problem of introducing the web of wrapping material. This introduction can now be realized easier and during a shorter period of time. The accessibility of the channel is improved. The forming shoulder is divided into at least three parts, meaning it may also include four or more parts. At least two parts are divided in accordance with the first division plane. At least the two parts of the forming shoulder being divided by the first division plane are movable with respect to one another, preferably by a drive, such that the parts are not only moved during assembly of the forming shoulder at the bag forming machine, but also during the insertion operation, meaning at the beginning of operation, when the web of wrapping material is torn and when a roll of wrapping material is to be replaced. The movement of the parts of the forming shoulder with respect to one another is realized by a stroke of movement the end of which being determined by the closed position of the parts of the forming shoulder and the other end of which being determined by the opened position of the parts of the forming shoulder. The closed position is determined such that no disadvantageous gaps occur between the movable parts of the forming shoulder and the stationary part in this position. Otherwise, the wrapping material could enter such gaps and get clamped therein. On the other hand, the cross-section of the channel is increased in the opened position such that a filling pipe can be removed from the channel not only by an axial movement, but also by a movement substantially perpendicular to the center axis of the filling pipe. It is also possible to realize intermediate positions between the closed position and the opened position. Especially when changing the roll of wrapping material using the gluing technique, this is advantageous. In this case, the removably supported filing pipe can substantially remain located in place, and the relative movement of the two separate parts of the forming shoulder is sufficient to enlarge the thickness of the passage gap such that the joint can be pulled through the enlarged passage gap without the danger of tear. Removal of the filling pipe and introduction of the filling pipe into the channel by a movement being substantially perpendicular to the center axis only requires a comparatively small stroke for the filling pipe and thus a substantially smaller space compared to axial removal. Another advantage is that dosing units being arranged above may remain in place during assembly and disassembly of the filing pipe. On the other hand, the filling pipe after being moved slightly towards the front, meaning perpendicular to the center axis, may also be pulled in an upward direction out off the tube to pass the dosing unit and to be reintroduced into the tube, for example after having removed an obstruction in the filling pipe.

The present invention may be realized in various applications. For example, it may be used when operating with one layer or with a plurality of layers, meaning when one web of wrapping material or a plurality of webs of wrapping material are converted into the tubular form at the forming shoulder. The invention may be used in an especially advantageous way when one operates with a plurality of webs one next to the other. Especially, these webs are produced as a plurality of adjacent webs of wrapping material by cutting a comparatively wide web being wound up on a roll. The plurality of webs is then fed to the plurality of adjacent forming shoulders without spreading of the webs. The design of the contour of the movable parts of the forming shoulder and the geometry of movement about the rotational axes are chosen such that an available space being rectangular in a horizontal section is not exceeded. The width of the available space corresponds to the division of the webs of wrapping material. In this way, it is possible to process a plurality of webs without spreading. The forming shoulders being located one next to the other in the division may be operated independently. The smaller the diameter of the tubular bag to be produced is, the more the advantages of the invention of a decreased insertion time and improved accessibility are perceivable.

The forming shoulder may be divided and the movable parts of the forming shoulder may be movable in a way that the channel partly formed by these parts at least in the closed position surrounds the filling pipe by more than half of its circumference. In the opened position, the passage gap is increased in a way that it allows for simplified handling of the web of wrapping material. Usually, the entire channel surrounds the filing pipe by almost 360° of the circumference with the exception of the opened portion in the region of the collar ends of the two movable parts of the forming shoulder. These ends may be designed in a spaced apart manner or to overlap depending on what kind of longitudinal seal seam is realized. The present invention is usable no matter whether a so called "fin seal" or an overlapping seal is used.

The at least two parts of the forming shoulder being separated by the above described division plane are movable with respect to one another such that one attains an increased opening at the opened side of the channel in the opened position. This increase is chosen such that the distance between the parts of the forming shoulder is greater than the diameter of the filling pipe. Accordingly, the filling pipe can be removed from the channel and be reassembled in the channel by a movement which is substantially perpendicular to the center axis of the filing pipe and of the forming shoulder. At the same time, the wrapping material may also be introduced into the channel by a movement which is substantially perpendicular to the center axis of the filling pipe and of the forming shoulder. This is insofar advantageous as twisting together the wrapping material before its introduction is not necessarily required, but instead only folding. Handling may even be realized in a way that the wrapping material as a plain web is deformed into its tubular form when introducing the filing pipe into the channel.

The controlled drive may be associated with a spring, especially a leg spring, for realizing the return movement of the two parts of the forming shoulder into the closed position. The controlled drive thus only realizes the opening stroke, while the closing stroke is realized by the spring. Such an arrangement desires to choose the force of the spring to be smaller than the force being applied by the controlled drive onto the movable parts during the opening stroke. In this way, it is taken into account that an operator holds the two edges of the web of wrapping material during its introduction by his hand to attain a symmetric position of the web of wrapping material and to tighten it. When closing the movable parts of the forming shoulder by the spring injuries and squeezing of the fingers of the operator are prevented.

It is especially advantageous if the movable parts of the forming shoulder are designed and arranged to be pivoted about a common rotational axis being located in the first division plane on the rear side of the filling pipe, meaning facing away from the operator. This position of the common rotational axis does not only allow for symmetric movement of the movable parts with respect to one another, but also a radial movement of important portions of the movable parts of the forming shoulder when being moved into the closed position in a special way. These portions are thus moved perpendicular to the surface of the web of wrapping material or, in other words, radial to the center axis of the filling pipe. On the other hand, the channel is optimally accessible in the opened position of the movable parts.

It makes especially sense if the stationary part of the forming shoulder in its upper portion is designed as a stationary cap or is connected to such a stationary cap. The cap includes a guiding surface for the web of wrapping material. The design and arrangement of the guiding surface always remain constant, meaning also during the opened position of the forming shoulder such that the web of wrapping material is always reproducibly deformed from its plain configuration into its tubular configuration under the same conditions. It is also possible and it also makes sense if the cap located at the upper end of the stationary part of the forming shoulder covers and surrounds, respectively, the contours of the movable parts of the forming shoulder as seen in the vertical projection. In this way, the movable parts are located "in the shadow" of the cap in the closed position, at least relative to the moving direction of the wrapping material.

The cap of the forming shoulder in the insertion region of the wrapping material preferably has a width corresponding to the width of the wrapping material. In this way, the wrapping material with its surface is fully supported by the guiding surface in the region of the cap, and its shape is changed. The width of the cap also is the maximum width of the forming shoulder. If the width of the cap corresponds to the division of a web of wrapping material to be processed as a plurality of adjacent webs, the single webs can be processed next to one another without spreading. This is especially advantageous when manufacturing bags having a width of approximately 1 centimeter or less.

The cap of the forming shoulder preferably is separated from the two movable parts of the forming shoulder by a second division plane being perpendicular to the center axis of the filling pipe and of the forming shoulder. Usually, the cap is designed as one piece. However, it is also possible that the downward portion of the cap is formed by a protrusion or by another portion being fixedly connected to the cap in a stationary way.

If the division plane is arranged such that the intersecting line between the division plane and the channel in the stationary part of the forming shoulder surrounds by slightly more than half of the circumference, one attains an especially well transition at the wrapping material when its shape is deformed.

In all embodiments in which one operates with a plurality of webs, the contour of the movable parts is chosen such that it is located inside of the division of the forming shoulders. The rectangular or cuboid space provided by the division may not be exceeded in any position of the parts. The division corresponds to the width of the wrapping material when operating with a plurality of webs without spreading of the plurality of webs of wrapping material.

The tool with its features designed above is a major component of a bag forming machine.

It makes sense in the novel bag forming machine to use a controlled drive for realizing the relative movement of the movable parts of the forming shoulder during deformation of the wrapping material into the tube to allow for automatic change of the rolls without having to introduce the web of wrapping material.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
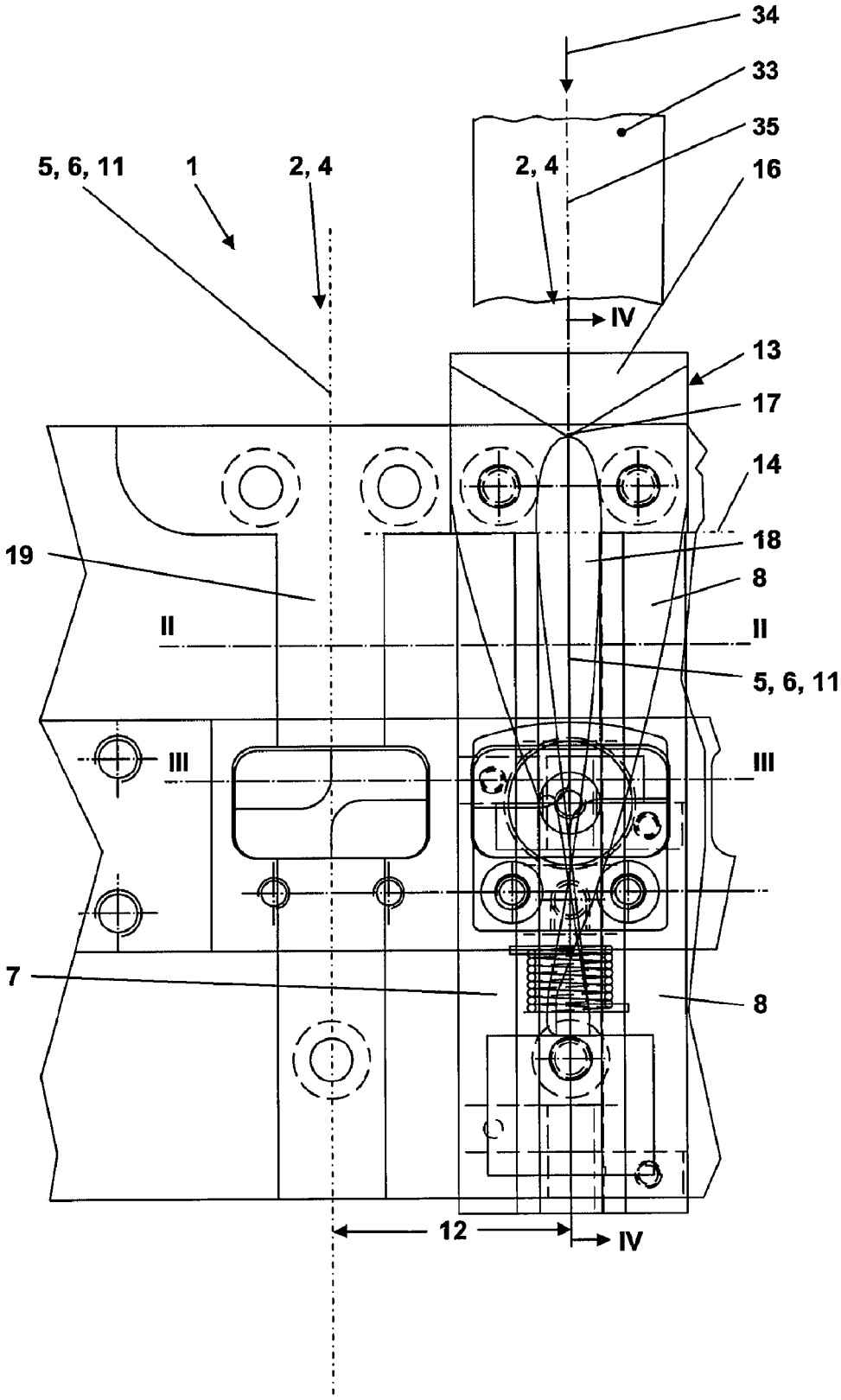
FIG. 1 is a view of a first exemplary embodiment of the novel bag forming machine including two adjacent forming shoulders with their respective filling pipes.
Figure 2:
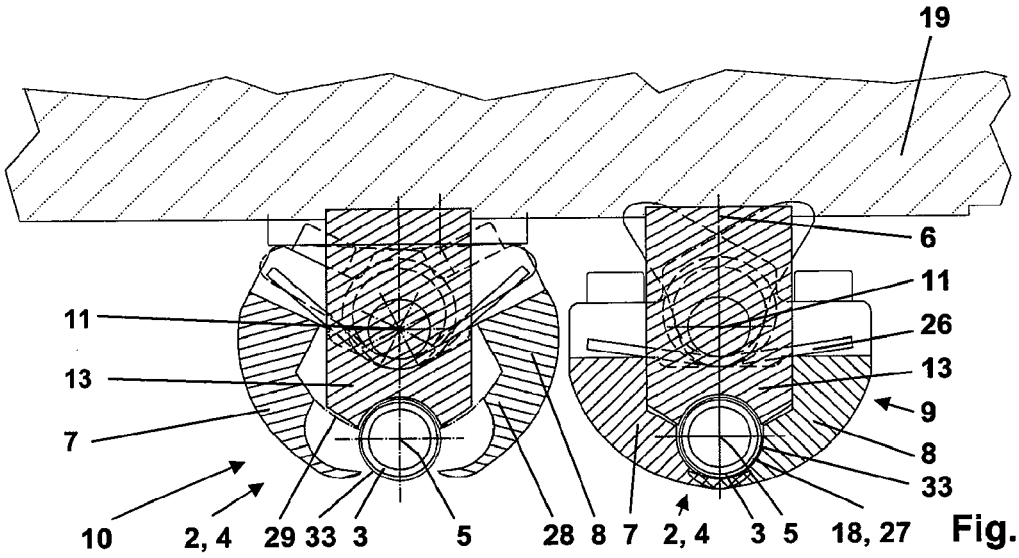
FIG. 2 is a horizontal sectional view along line II-II in FIG. 1.

Referring now in greater detail to the drawings, FIG. 1 illustrates the most important elements of a first exemplary embodiment of the novel vertical bag forming machine 1. In the illustrated example, the bag forming machine 1 includes two adjacent forming shoulders 2. However, due to the chosen perspective, only one forming shoulder 2 is illustrated. Each forming shoulder 2 is associated with a filling pipe 3 (FIG. 2). Each forming shoulder 2 together with the associated filling pipe 3 forms a tool 4 for deforming a web of wrapping material 33. The wrapping material 33 is only schematically illustrated. The wrapping material 33 has a center line 35, and it is transported in the direction of arrow 34. It is to be understood that the web of wrapping material 33 coming from a roll and being unwound into its flat position is deformed by the tool 4 to form a tube for later producing tubular bags for packing goods, as this concept is generally known in the art.

Each tool 4 includes a center axis 5. The center axis 5 at the same time is the center axis of each filling pipe 3 and each forming shoulder 2. Each forming shoulder 2 is divided by a first division plane 6 in a way to form two movable parts, namely a first part 7 and a second part 8. The division plane 6 extends through the center axis 5 and the center line of the web of wrapping material. In this way, the division plane 6 is located to be perpendicular to the plane of illustration of FIG. 1. In this way, each forming shoulder 2 includes the two separate parts 7 and 8.

Figure 3:
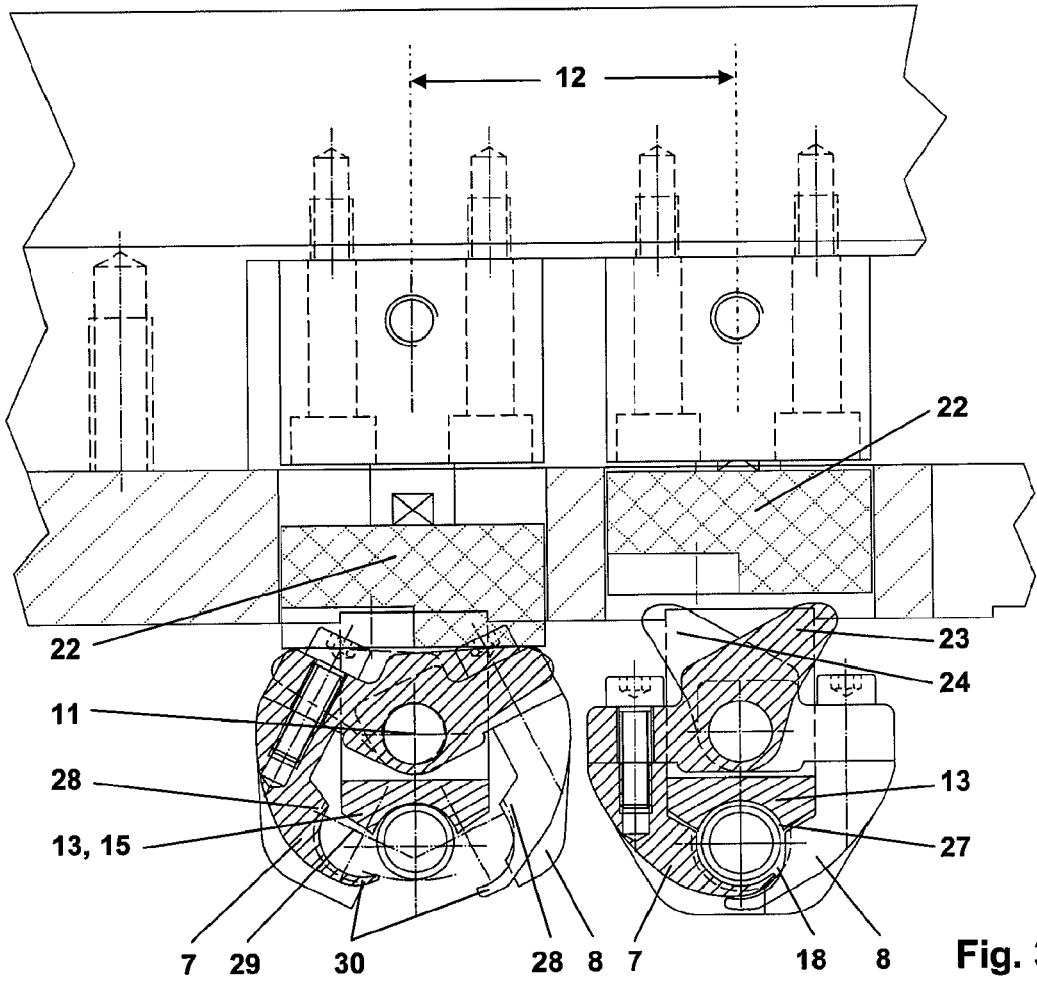
FIG. 3 is a horizontal sectional view along line III-III in FIG. 1.

FIGS. 2 and 3 illustrate two forming shoulders 2 to explain the different positions which may be taken by the movable first and second parts 7, 8 of each forming shoulder 2. The forming shoulder 2 being illustrated on the right hand side of FIGS. 2 and 3 is located in the closed position 9. The forming shoulder 2 being illustrated in the left part of FIGS. 2 and 3 is located in the opened position 10. To allow for the relative movement of the parts 7 and 8 with respect to one another and symmetric with respect to the first division plane 6, respectively, the parts 7 and 8 of the forming shoulder 2 are arranged to be pivotable about a common vertical rotational axis 11. The contours of the parts 7 and 8 are designed as is to be seen from the cross-section illustrated in FIG. 2 to allow for the required movement of the parts 7 and 8 from the closed position 9 into the opened position 10 with out exceeding a three-dimensional cuboid and without blocking one another. This three-dimensional cuboid is determined by the division 12 corresponding to the distance between the center axes 5 and the division planes 6, respectively, with respect to one another. The division 12 corresponds to the width of the web of wrapping material 33 when being located in a plane.

Figure 5:
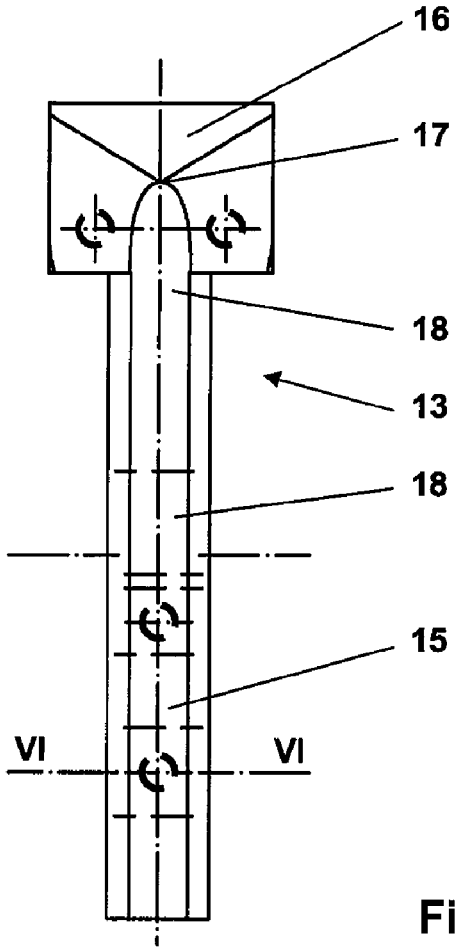
FIG. 5 is a view of the stationary third part of the forming shoulder.
Figure 6:
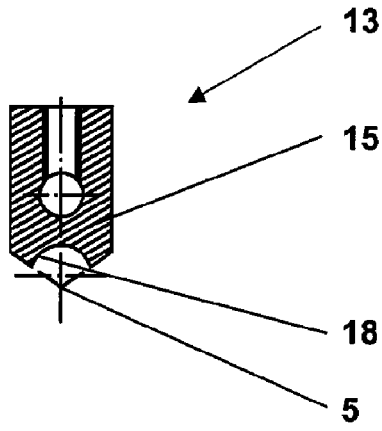
FIG. 6 is a horizontal sectional view along line VI-VI in FIG. 5.

In addition to the movable first part 7 and the movable second part 8, each forming shoulder 2 includes a third stationary part 13. The stationary part 13 may also be designated as a cap. The stationary part 13 extends over the entire height of each forming shoulder 2 and of each tool 4, respectively, and it is to be seen best in the separate illustration of FIGS. 5 and 6. The stationary part 13 may be designed as one piece, or to include a plurality of pieces. The stationary part 13 is formed with respect to the movable parts 7 and 8 by a second division plane 14 at the forming shoulder 2. The second division plane 14 is a horizontal division plane, meaning it is located perpendicular on the first division plane 6 and thus on the center axis 5. However, this does not mean that the stationary part 13 does not include a protrusion 15 extending in a downward direction (FIG. 5). A guiding surface 16 is located in the upper portion of the third part 13, the guiding surface 16 at a deflecting edge 17 being connected to a channel 18 which begins at this place. The channel 18 serves to accommodate the filling pipe 3. The channel 18 in the upper portion of the part 13, meaning above the second division plane 14, is exclusively formed by the stationary part 13. In the region of the protrusion 15, the stationary part 13 only forms a circumferential region of the channel 18 referring to an angle of approximately 110°, as this is to be seen in FIG. 6.

Figure 4:
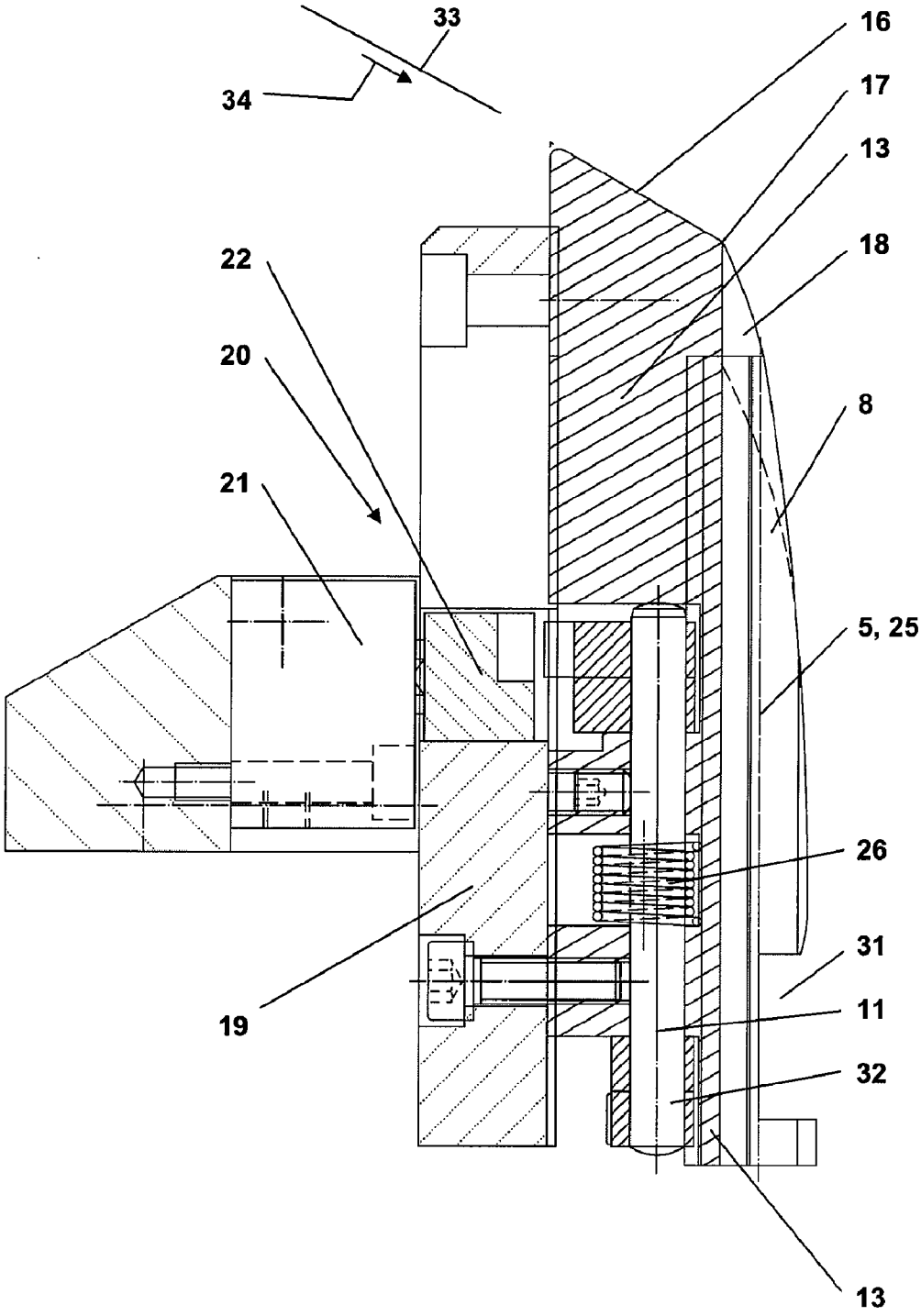
FIG. 4 is a vertical sectional view along line IV-IV in FIG. 1.

The stationary part 13 of each forming shoulder 2 is fixedly connected to a common carrier 19 for supporting a plurality of forming shoulders 2. The forming shoulders 2 are located side by side, and they may be connected to the carrier 19 by screws, for example, as this is illustrated in FIG. 4. A controlled drive 20 extends through the carrier 19 in the region of each forming shoulder 2. The controlled drive 20 includes a pneumatic cylinder 21 and a pressure piece 22 which is similar to a piston rod. The stroke of the pressure piece 22 is transmittable to the movable parts 7 and 8 of the forming shoulder 2. For this purpose, the movable part 7 of the forming shoulder 2 includes a nose 23 and the movable part 8 includes a nose 24. The noses 23, 24 cooperate with the pressure piece 22 of the controlled drive 20. The movable parts 7 and 8 of each forming shoulder 2 are moved from the closed position 9 into the opened position 10 due to controlled extension of the pressure piece 22 from the pneumatic cylinder 21 of the drive 20, as is to be seen from the comparison of FIGS. 2 and 3. The movable parts 7 and 8 of each forming shoulder 2 hereby pivot about the common rotational axis 11. It is to be seen in FIG. 4 that the common rotational axis 11 extends through the center axes 5 of adjacent forming shoulders 2 behind a vertical plane 25. The controlled drive 20 which may also be designed to be hydraulically or electrically driven is associated with a return spring being designed as a leg spring 26. The leg spring 26 with its spring ends contacts the two parts 7 and 8, and it acts upon the parts 7 and 8. As soon as the controlled drive 20 has been released from the opened position 10, the force of the leg spring 26 becomes effective, and the movable parts 7 and 8 are pivoted back into the closed position 9. However, it is also possible not to arrange a return spring and to instead design the drive 20 similar to a double acting cylinder and the like.

In the closed position 9 of each forming shoulder 2, there is a passage gap 27 for the wrapping material 33 in tubular form. The passage gap 27 is located in the region of the channel 18 between the outer wall of the filling pipe 3 and the inner wall of the channel 14 of the parts 7, 8 and 13 of the forming shoulder. The width of the passage gap 27 may be slightly greater than the thickness of the wrapping material 33, especially when producing bags with a small width.

It is especially to be seen in FIG. 3 that the outer contour of the movable parts 7 and 8 of the forming shoulder 2 is designed such that forming shoulders 2 being located next to one another within the division 12 may be opened independently. Another special feature of the movable parts 7 and 8 of each forming shoulder 2 is the fact that the parts 7 and 8 include portions 28 being located adjacent to the stationary part 13 and its protrusion 15, respectively. When pivoting the movable parts 7 and 8 from the opened position 10 into the closed position 9, these portions 28 move approximately in a radial direction 29 and thus approximately perpendicular to the surface of the wrapping material 33 and of the filling pipe 3, respectively. In this way, squeezing of the wrapping material 33 at this place during movement of the movable parts 7 and 8 from the opened position 10 into the closed position 9 is securely prevented.

When pivoting the movable parts 7 and 8 about the common rotational axis 11, other portions 30 are pivoted in a tangential direction with respect to the surface of the filling pipe 3 and of the wrapping material 33, respectively. However, this tangential movement does not take place in the region of the edges of the wrapping material 33. These edges are held by the hand of the operator when introducing the wrapping material 33. Consequently, squeezing of the wrapping material 33 at this place is not to be expected. In this region, the movable parts 7 and 8 of the forming shoulder 2 are not designed to be symmetric, but they correspond to the desired longitudinal sealed seam of the wrapping material 33. To be capable of engaging and guiding the edges of the wrapping material 33, the parts 7 and 8 include a cutout 31 having a size corresponding to the fingers of a hand. This cutout 31 also serves to ensure that the edges of the wrapping material 33 during its continuous movement through the machine 1 respectively overlap.

A bolt 32 is arranged in the common rotational axis 11. The bolt 32 is part of a pivot bearing for the two movable parts 7 and 8 of the forming shoulder 2. The bolt 32 is supported and guided in respective bearings.

Many variations and modifications may be made to the preferred embodiments of the invention without departing substantially from the spirit and principles of the invention. All such modifications and variations are intended to be included herein within the scope of the present invention, as defined by the following claims.

We claim:

1. A tool for a bag forming machine for deforming a plain web of wrapping material into a tube, comprising:

a filling pipe having a surface and a center axis; and a forming shoulder including a first part, a second part and a third part, the forming shoulder including a channel, said filling pipe being arranged in said channel, said filling pipe and said channel being designed and arranged to form a passage gap, said passage gap being designed and arranged to allow for passage of the web of wrapping material and of the tube, the third part being designed and arranged to be stationary and to continuously extend in a vertical direction to limit said channel by a circumferential angle which is less than 180°, said first part and said second part being arranged next to said third part to form a part of said channel;

said forming shoulder being designed and arranged to be divided in a division plane to form said first part and said second part, the division plane being defined by the center axis, said first part and said second part being designed and arranged to be pivotable with respect to one another such that the first part and said second part can be moved into a closed position in which they surround said filling pipe and into an opened position, said first part and said second part being designed and arranged to be pivotable such that they move approximately in a radial direction with respect to the surface of said filling pipe when being moved into the closed position.

2. The tool of claim 1, wherein said forming shoulder is divided and said first part and said second part are designed and arranged to be movable such that said channel being partly formed by said first part and said second part at least in the closed position surrounding said filing pipe by more than half of its circumference, and said passage gap in the opened position having an increased size allowing for simplified handling of the wrapping material.

3. The tool of claim 1, wherein said first part and said second part are connected to a controlled drive, said controlled drive being designed and arranged to move said first part and said second part from said closed position into said opened position.

4. The tool of claim 3, wherein said controlled drive is connected to a spring, said spring being designed and arranged to move said first part and said second part from the opened position into the closed position.

5. The tool of claim 1, wherein said first part and said second part are designed and arranged to be pivoted about a common rotational axis, the rotational axis being located in the division plane in a direction towards said third part.

6. The tool of claim 1, wherein said third part has an upper portion including a guiding surface, said guiding surface being designed and arranged to guide the wrapping material.

7. The tool of claim 6, wherein said upper portion has a width in a region where the wrapping material is introduced, the width corresponding to the width of the wrapping material.

8. The tool of claim 6, wherein said upper portion is designed and arranged to be separated from said first part and said second part by a second division plane, the second division plane being arranged to be perpendicular to the center axis.

9. The tool of claim 8, wherein the second division plane is arranged such that an intersection line between the second division plane and said channel surrounds said channel in said third part by slightly more than half of the circumference.

10. The tool of claim 1, wherein the division plane is defined a center line of the wrapping material.

11. The tool of claim 1, wherein said first part and said second part are designed and arranged to be pivotable such that they move approximately perpendicular to an extension of the wrapping material in a circumferential direction when being moved into the closed position.

12. A bag forming machine for deforming a web of wrapping material into a tube, comprising:

a filling pipe having a surface and a center axis; and a forming shoulder including a first part, a second part and a third part, the forming shoulder including a channel, said filling pipe being arranged in said channel, said filling pipe and said channel being designed and arranged to form a passage gap, said passage gap being designed and arranged to allow for passage of the web of wrapping material and of the tube, the third part being designed and arranged to be stationary and to continuously extend in a vertical direction to limit said channel by a circumferential angle which is less than 180°, said first part and said second part being arranged next to said third part to form a part of said channel;

said forming shoulder being designed and arranged to be divided in a division plane to form said first part and said second part, the division plane being defined by the center axis, said first part and said second part being designed and arranged to be pivotable with respect to one another such that the first part and said second part can be moved into a closed position in which they surround said filling pipe and into an opened position, said first part and said second part being designed and arranged to be pivotable such that they move approximately in a radial direction with respect to the surface of said filling pipe when being moved into the closed position.

13. The machine of claim 12, wherein said forming shoulder is divided and said first part and said second part are designed and arranged to be movable such that said channel being partly formed by said first part and said second part at least in the closed position surrounding said filing pipe by more than half of its circumference, and said passage gap in the opened position having an increased size allowing for simplified handling of the wrapping material.

14. The machine of claim 12, wherein said first part and said second part are connected to a controlled drive, said controlled drive being designed and arranged to move said first part and said second part from said closed position into said opened position.

15. The machine of claim 14, wherein said controlled drive is connected to a spring, said spring being designed and arranged to move said first part and said second part from the opened position into the closed position.

* * * * *